United States Patent [19]

Palmer et al.

[11] Patent Number: 4,963,848

[45] Date of Patent: Oct. 16, 1990

[54] NON-JAMMING MAGNETIC TRIP STRUCTURE

[75] Inventors: Neil R. Palmer; Paul Rustebakke, both of Swisher, Iowa

[73] Assignee: Square D Company, Palatine, Ill.

[21] Appl. No.: 331,976

[22] Filed: Mar. 31, 1989

[51] Int. Cl.[5] ..... H01H 9/00

[52] U.S. Cl. ..... 335/172; 335/174

[58] Field of Search ..... 335/35–38, 335/23, 42, 172–176, 279

[56] References Cited

U.S. PATENT DOCUMENTS

| | | | |
|---|---|---|---|
| 3,098,136 | 7/1963 | Stanback et al. . | |
| 3,355,685 | 11/1967 | Leonard . | |
| 3,949,333 | 4/1976 | Freitag et al. . | |
| 4,037,183 | 7/1977 | Gaskill . | |
| 4,525,694 | 6/1985 | Dennison et al. . | |
| 4,595,812 | 6/1986 | Tamaru et al. . | |
| 4,616,200 | 10/1986 | Fixemer et al. . | |
| 4,698,903 | 10/1987 | Ciarcia et al. . | |
| 4,706,054 | 11/1987 | Hampton et al. | 335/38 |
| 4,725,800 | 2/1988 | Grunert et al. | 335/38 |
| 4,731,921 | 3/1988 | Ciarcia et al. . | |

*Primary Examiner*—Leo P. Picard
*Assistant Examiner*—Lincoln Donovan
*Attorney, Agent, or Firm*—Larry I. Golden; Jose W. Jimenez

[57] ABSTRACT

A fastenerless electromagnetic trip assembly employs minimal parts for effecting the release of a set of circuit breaker contacts. The parts include an armature, an armature bias spring, a yoke and a trip bar, all of which may be retractably supported in associated compartments within the circuit breaker housing. The yoke provides an electromagnetic field in response to electric current flowing in the circuit breaker. A spring biases the armature until the electromagnetic field reaches a predetermined strength, at which point the bias is overcome, and the armature strikes the trip bar and is drawn toward the yoke, thereby causing the trip member to actuate the release of the circuit breaker contacts.

33 Claims, 4 Drawing Sheets

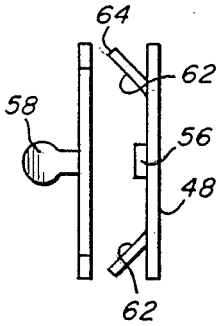
FIG. 3a
FIG. 3b
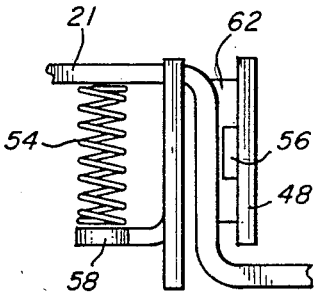
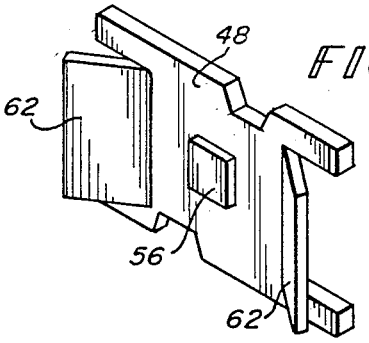
FIG. 4
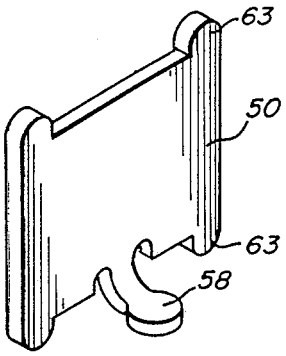
FIG. 5
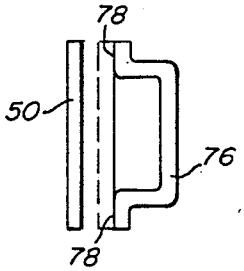
FIG. 8a
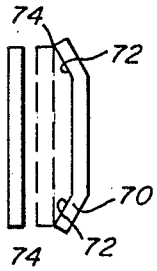
FIG. 7a
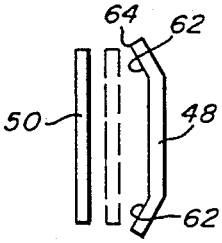
FIG. 6a
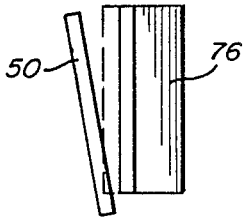
FIG. 8b
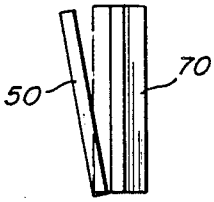
FIG. 7b
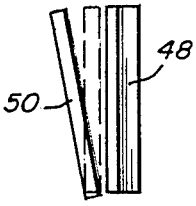
FIG. 6b

NON-JAMMING MAGNETIC TRIP STRUCTURE

TECHNICAL FIELD

The present invention relates generally to electromagnetic contactors, and, more particularly, to magnetic trip structures often incorporated within circuit breakers.

BACKGROUND ART

Magnetic trip structures are designed to respond to a current overload detected in a circuit breaker. Typically, an electromagnet provides a magnetic field in response to the current flowing through the breaker. When the current level increases beyond a predetermined threshold, the magnetic field increases to a level which is sufficient to attract an armature toward the electromagnet. The armature is biased away from the electromagnet in its normal, untripped state using a combination of springs, clamps and/or friction bearing devices. In known structures, movement of the armature toward the electromagnet and away from a coupling mechanism causes the coupling mechanism to release circuit breaker contacts, thereby "breaking" the circuit.

The manufacture of such electromagnetic trip structures has been cumbersome and labor intensive. This is primarily due to the many intricate parts that must be assembled in the structures. Manipulation of these many parts is made significantly more difficult by the manner in which they are interconnected. For example, fasteners such as locking pins, rivets, brackets, and costly threaded couplings are commonly used. Unfortunately, the labor that is required due to both the number of parts and their interconnections cannot be tolerated for many cost conscious applications.

This problem is aggravated by post-manufacture maintenance. Maintenance is usually required due to wear and tear of the many parts as well as due to the collection of debris and particles within those parts. A particular type of particle, molten metal which becomes solidified, is often found in a circuit breaker after a current overload is experienced by metallic conductors within the breaker. The molten metal emanates from the metal which carries the overload current. This type of particle has become lodged in known electromagnetic trip structures, causing the structures to jam. Ensuing damage typically includes, at a minimum, damage to appliances powered through the breaker and damage to the circuit breaker itself.

DISCLOSURE OF INVENTION

It is a general object of the present invention to provide an electromagnetic trip structure for a circuit breaker which overcomes the problems set forth above.

It is a more particular object of the present invention to provide an electromagnetic trip structure that may be assembled with few parts, without fasteners and without post-assembly adjustments or calibration.

It is another object of the present invention to provide a circuit breaker having an electromagnetic trip structure that is essentially non-jamming.

In accordance with a preferred embodiment of the present invention, the foregoing objectives are realized by providing an electromagnetic trip assembly for effecting the release of a set of circuit breaker contacts. The operative parts are minimal. They include an armature, a compressible spring, a yoke and a trip member, all of which are retractably supported, i.e., without fasteners, in associated compartments within the breaker housing. An electromagnetic field is induced in the yoke by current flowing in the circuit breaker. Normally, the spring biases the armature away from the yoke. But, in response to an overload current and thus a sufficient electromagnetic field, the bias is overcome and the yoke draws the armature toward the yoke, compressing the spring forcing the armature against the trip member to effect the release of the set of circuit breaker contacts. Preferably, the armature strikes the trip member as the armature moves toward the yoke.

According to another aspect of the present invention, the yoke includes a recessed surface having pole faces protruding therefrom to form a concave shape. The pole faces are designed to reduce the surface area at the interface between the armature and the yoke. This design substantially reduces and practically eliminates any possibility of particle collection therebetween; therefore, it avoids damage that might otherwise result from jamming of the electromagnetic trip assembly.

BRIEF DESCRIPTION OF THE DRAWINGS

Other objects and advantages of the invention will become apparent upon reading the following detailed description and upon reference to the accompanying drawings, in which:

FIG. 3*a* is a top view of an armature and a yoke situated as employed in the electromagnetic trip structure of FIG. 1;

FIG. 3*b* is a side view of part of the electromagnetic trip structure of FIG. 1;

FIG. 4 is a front view of the yoke as employed in the electromagnetic trip structure of FIG. 1;

FIG. 5 is a front view of the yoke as employed in the electromagnetic trip structure of FIG. 1;

FIG. 6*a* is a top view of the armature and the yoke also illustrated in FIGS. 1–5, with a depiction of the armature movement;

FIG. 6*b* is a side view of the armature and the yoke of FIG. 6*a*, with a depiction of the armature movement;

FIG. 7*a* is a top view of an alternative armature and yoke arrangement which may be employed in the electromagnetic trip structure of FIG. 1, according to the present invention;

FIG. 7*b* is a side view of the alternative armature and yoke arrangement of FIG. 7*a;*

FIG. 8*a* is a top view of another alternative armature and yoke arrangement which may be employed in the electromagnetic trip structure of FIG. 1, according to the present invention;

FIG. 8*b* is a side view of the alternative armature and yoke arrangement of FIG. 8*a;*

Figure 1:
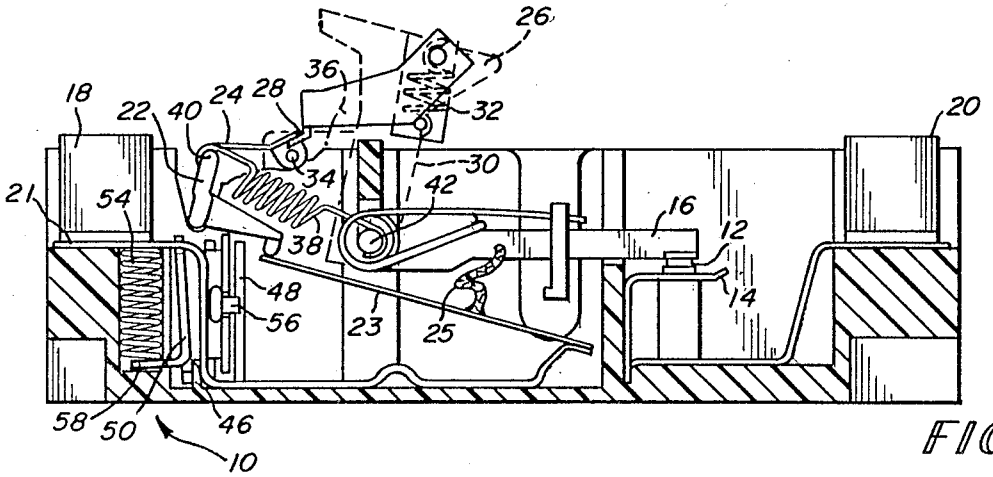
FIG. 1 is a sectional view of a circuit breaker including an electromagnetic trip structure, according to the present invention, and showing the trip structure in its reset position.

While the invention is susceptible to various modifications and alternative forms, specific embodiments thereof have been shown by way of example in the drawings and will herein be described in detail. It should be understood, however, that it is not intended to limit the invention to the particular forms disclosed. On the contrary, the intention is to cover all modifications, equivalents, and alternatives falling within the spirit and scope of the invention as defined by the appended claims.

BEST MODE FOR CARRYING OUT THE INVENTION

The present invention has direct application for releasing a set of contacts in a circuit breaker. The release is effected through the action of an electro-magnetic trip structure assembled from a minimum number of parts. As such, the assembly is especially useful for circuit breakers which are manufactured in high volume.

FIG. 1 illustrates such an electromagnetic trip assembly 10 within a plastic, molded circuit breaker housing 47 (top cover of housing removed). The circuit breaker is shown in its normal untripped or reset position having contacts 12 and 14 closed and the electromagnetic trip assembly 10 reset. In the normal position, the electromagnetic trip assembly 10 provides an electrical path between terminal blocks 18 and 20 via a conductor 21, a thermostatic metal strip 23, a movable blade 16, a braided wire 25 soldered to the strip 23 and to the blade 16, and, finally, via the contacts 12 and 14. The contact 12 is part of a movable blade 16 which is withdrawn from contact 14 when the electromagnetic trip assembly 10 is tripped. In the tripped position, as illustrated in FIG. 2, the contacts 12 and 14 are separated from each other to break the circuit.

Figure 2:
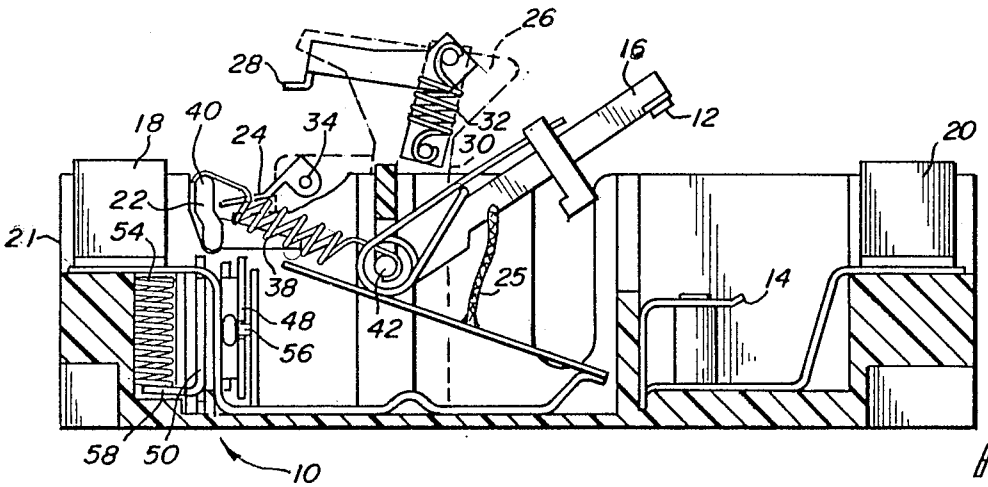
FIG. 2 is the same sectional view of the circuit breaker of FIG. 1 showing the electromagnetic trip structure in its tripped position.

The tripping operation of the electromagnetic trip assembly 10 is best understood by first considering the reset position in FIG. 1, while on occasion referring to FIG. 2 to illustrate the tripped position As shown in FIG. 1, the assembly 10 includes a plastic trip bar 22 supporting a finger 24. When the finger 24 is supported, the finger maintains the reset position of the circuit breaker by preventing a conventional toggle assembly 26 from rotating in the clockwise direction. The finger 24 is biased by a spring 32 and is held in place about an axle 34 by a pivotal support 36 extending from the toggle assembly 26. The spring 32 is coupled to the finger 24 at one end and to a supporting structure 30 (shown in dotted lines) at the other end.

The toggle assembly 26 is conventionally used in the QO series of circuit breakers available from Square D Company, Palatine, Ill. The toggle assembly 26 is cocked counterclockwise to reset the circuit breaker into the position shown in FIG. 1. For a detailed description of the structure and operation of the toggle assembly 26, reference may be made to U.S. Pat. Nos. 3,098,136; 3,355,685 and 4,616,200, all of which are incorporated herein by reference.

To "trip" the circuit breaker, the magnetic trip assembly rotates the trip bar 22 in the counterclockwise direction, which removes support for the finger 24. This permits the spring 32 to rotate the finger 24 in the counterclockwise direction and actuate the toggle assembly 26 by releasing a spring latch 28 in the toggle assembly 26. When the spring latch 28 is released, the toggle assembly 26 breaks the electrical connection at the contacts 12 and 14 by retracting the movable blade 16 in a spring-like manner to the tripped position shown in FIG. 2. Alternatively, the thermostatic metal strip 23 may engage the trip bar 22 at trip bar foot 43 in response to an excessive temperature.

To support the toggle assembly 26 in the position shown in FIG. 1, the trip bar 22 is biased by an extension spring 38. The spring 38 is hooked around a shoulder 40 of the trip bar and around the axle 42 about which the blade 16 and the toggle assembly rotate.

The present invention more particularly concerns the electromagnetic trip assembly 10. For rotating the trip bar 22, the assembly 10 includes a yoke 48, an armature 50 and an armature spring 54 which biases the armature 50 away from the yoke 48 in the reset position as shown in FIG. 1. The spring 54 is compressed between the conductor 21 and a protruding seat 58 of the armature 50. As illustrated in and subsequently discussed in connection with FIGS. 9 and 10, the yoke 48, the armature 50 and the spring 54 are retractably held in place by associated compartments within the circuit breaker housing 47. Also under the force of the spring 54, the armature 50 rests against the housing 47, and its bottom is retained by a short wall 46 formed in the housing 47. An insulating knob 56 is secured in the center of the yoke 48 to prevent the yoke 4 from making contact with the conductor 21.

The yoke 48 is magnetized by current flowing through the conductor 21. When the amount of current flowing through the conductor 21 increases beyond a predetermined threshold, the magnetic field linking the yoke 58 and the armature 50 increases to a level which is sufficient to rotate or pivot the armature 50, about the short wall 46, toward the yoke 48. When the current level reaches this threshold, the armature 50 strikes the bottom of the trip bar 22 while being drawn toward the yoke 48. This action causes the trip bar 22 to rotate in the counterclockwise direction and trip the toggle assembly 26 to break the connection between the contacts 12 and 14, as described above.

The current level threshold for tripping the breaker directly corresponds to the spring constant of the spring 54. The spring 54 should be selected to bias the armature 50 at a slight angle away from the yoke 50, as shown in FIG. 1, with a force that is just overcome when the current level flowing through the conductor 21 increases beyond the predetermined threshold.

The spring may be changed to change the current rating of the circuit breaker. Accordingly, a single circuit breaker assembly can be used for a series of circuit breakers of different current ratings with the only difference being the type of spring 54. No other part substitutions or adjustments are required. Moreover, the retractability of the spring 54 and of the related trip assembly parts facilitates the circuit breaker assembly process, since no steps involving fasteners are required.

Another important aspect of the present invention involves the interaction between the armature 50, the yoke 48 and the trip bar 22. As a comparison of FIGS. 1 and 2 illustrates, when the electromagnetic field reaches the predetermined strength to draw the armature 50 toward the yoke 48, the top of the armature 50 strikes the trip bar 22 before the armature 50 reaches the yoke 48. Because the trip bar 22 is stricken before the armature 50 meets the yoke 48, small debris and particles which might fall between the armature 50 and the yoke 48 cannot prevent a successful tripping operation. This operation avoids what might otherwise result in severe electrical problems.

In FIGS. 3*a* and 3*b*, the yoke/armature arrangement is shown in more detail. FIG. 3*a* illustrates the yoke arrangement from a top perspective, i.e., looking through the spring 54 at the protruding seat 58 of the armature 50 in FIG. 1 or FIG. 2. This view illustrates one embodiment of the yoke shape in which a recessed surface 60 and two pole faces at opposite ends thereof form a concave section which faces the armature 50. The pole faces 62, in conjunction with the conductor 21, help to electromagnetically draw the armature 50 toward the yoke 48 when current is flowing through the conductor 21. As an added safety and non-jamming feature, the pole faces 62 include ends having minimal interface surface for maintaining a separation between the armature 50 and the yoke 48. This separation prevents particles from interfering with the movement of the armature 50.

FIG. 3*b* illustrates the yoke arrangement of FIGS. 1 and 2 from a side perspective as well as the spring 54 resting on the protruding seat 58 of the armature 50. In addition, the conductor 21 is shown disposed therebetween as in FIGS. 1 and 2. A pole face 62 (FIG. 3*a*) of the yoke 48 is shown in dotted lines.

FIGS. 4 and 5 respectively illustrate the yoke 48 and the armature 50 of FIGS. 1, 2, 3*a* and 3*b*. Both the yoke 48 and the armature 50 are stamped into the shape illustrated from respective sheets of low carbon steel. Extensions 63 of the armature 50 are used to strike the trip bar 22. They are sufficiently separated to allow the conductor 21 (FIG. 3*b*) to be secured by the housing therebetween without making contact with the armature 50.

In FIGS. 6*a*–6*b*, 7*a*–7*b* and 8*a*–8*b*, three alternative embodiments of the armature/yoke arrangement are illustrated. In each embodiment, the movement of the armature is depicted with dotted lines to show its position when fully drawn toward the yoke. FIGS. 6*a*, 7*a* and 8*a* illustrate a top view of each embodiment, while FIGS. 6*b*, 7*b* and 8*b* illustrate a side view of each embodiment. For clarity, the protruding seat 58 (FIGS. 1, 2 and 3*a*) of the armature 50 is omitted from FIGS. 6*a*–8*b*.

In FIGS. 6*a* and 6*b*, it is shown that the ends 64 of the yoke's pole faces 62 are separated by a distance that is greater than the length of the armature 50. In this embodiment and as discussed in connection with FIG. 10, the housing compartments which receive the yoke 48 and the armature 50 prevent actual contact from being made therebetween. The pole faces 62 angularly extend to the outside of the armature 50 to provide sufficient electromagnetic draw by the surfaces 62 during the tripping operation. Preferably, a distance of at least 0.020 inches is maintained between the armature 50 and the pole faces 62 at all times.

An alternative embodiment of the armature/yoke arrangement is shown in FIGS. 7*a* and 7*b*. The difference between this embodiment and the embodiment in the previous figures involves the surface area of the pole faces of each yoke. Unlike the previous embodiment, the yoke 70 of FIG. 7*a* includes pole faces 72 which angularly extend such that their ends 74 make contact with the armature 50 when fully drawn toward the yoke 70. Due to the edge-like contact that is made therebetween, the probability of particles jamming the tripping mechanism is greatly reduced but not completely eliminated. An advantage of this embodiment over the embodiment illustrated in FIGS. 6*a* and 6*b* is that the pole faces 72 in the yoke 70 of FIGS. 7*a* and 7*b* provide more electromagnetic draw than do pole faces 62 in the yoke 48 of FIGS. 6*a* and 6*b* when the same level of current is carried by the conductor 21.

An embodiment providing even greater electromagnetic draw is illustrated in FIGS. 8*a* and 8*b*. In this embodiment, a yoke 76 includes pole faces 78 which are parallel to the armature 50. Significant surface contact between the armature 50 and the pole faces 78 of the yoke 76, although increasing the electromagnetic draw, do not reduce the possibility of jamming to the extent provided by the embodiments of FIGS. 6*a*–6*b* and 7*a*–7*b*.

In each of the three embodiments of FIGS. 6*a*–8*b*, the conductor 21 would be employed between the yoke and the armature as illustrated in FIGS. 1, 2 and 3*b*.

Figure 9:
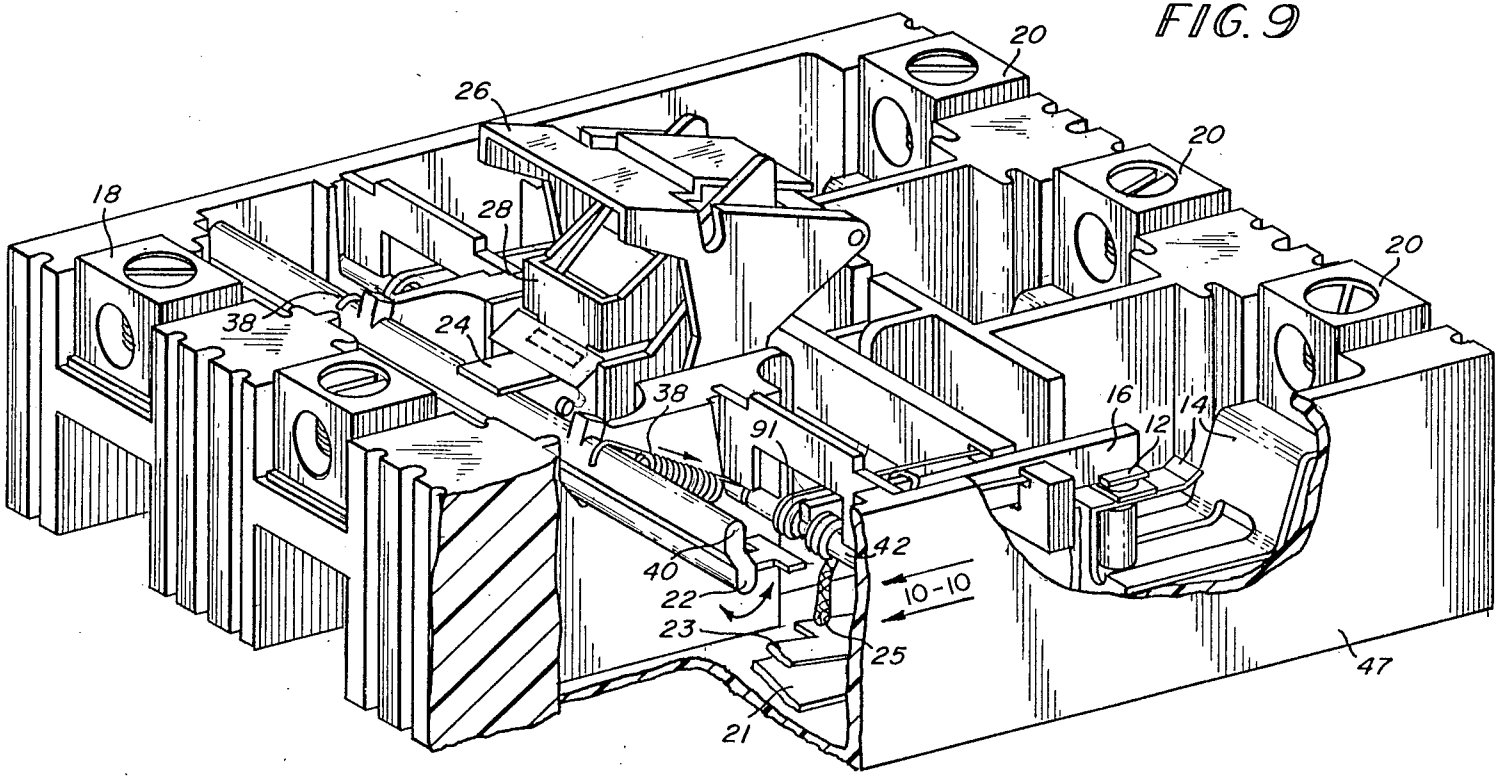
FIG. 9 is a perspective view of the structure of FIG. 1 included in a circuit breaker housing having three circuit paths.

Referring now to FIG. 9, a perspective view of the structure of FIG. 1 is included in the circuit breaker housing 47 of FIG. 1 with electrical paths, respectively defined between terminal blocks 18 and 20, for three circuits. A section of the housing 47 is cut-away to illustrate a detailed perspective view of the circuit breaker components of FIGS. 1 and 2. For example, finger 24 is shown supported by trip bar 22 to maintain a reset position on latch 28, and a pair of springs 38 are shown biasing the trip bar 22 to provide this support. In addition, springs 91 are shown on either side of the blades 16 as part of the toggle assembly 26 for rotating the blades 16 in the counterclockwise direction in response to the previously discussed tripping action.

Figure 10:
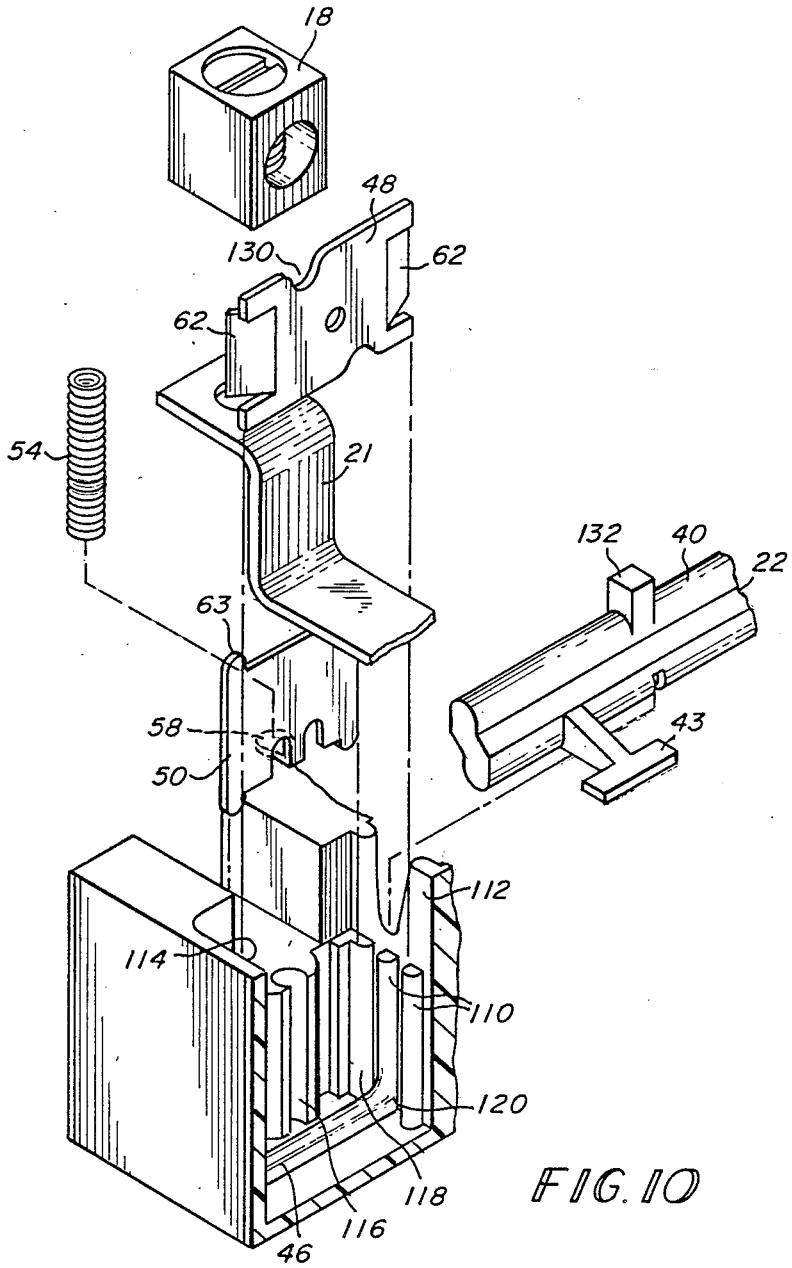
FIG. 10 is a perspective view of a section cut-away from the circuit breaker housing of FIG. 9 along lines 10—10 showing compartments for retractably receiving the components of the electromagnetic trip assembly.

In FIG. 10, a section of the housing 47 of FIG. 9 is illustrated with associated compartments for retaining the electromagnetic trip assembly 10 of FIG. 1. A compartment for the yoke 48 of FIG. 1 is provided by wall shoulders 110 along walls 112 and 114 which receive the body of the yoke 48, while the pole faces 62 of the yoke 48 are situated on the armature side of the shoulders 110. Further, a foot 120 of the walls 112 and 114 supports the yoke 48 above the conductor 21 to prevent contact from being made therebetween.

The compartment for the armature 50 includes two sections. One section 116 is tubularly shaped for receiving the spring 54 and the protruding seat 56 of the armature and the other section, for receiving the body of the armature 48, is defined by corners 118 on walls 112 and 114 and the inner shoulder 110. These shoulders rotatably retain the armature 50 about short wall 46 for movement between its normal position and its tripped position adjacent to the yoke 48. It should be apparent that each of these housing compartments receive the armature, yoke and spring by first sliding the armature into position, then placing the spring 54 on top of the seat of the armature, placing the conductor 21 over the armature and spring, and then sliding the yoke into position over the conductor 21. Each of the components 48, 50, or 54 may be easily retracted in the same order they were inserted since no fasteners are used or needed to secure the components to the housing.

Additional features concern the movement of the trip bar 22. A notch 130 in the yoke 48 prevents the foot 43 of the trip bar 22 from interfering with the movement of the trip bar 22 during the tripping operation. Also, a protrusion 132 on top of the trip bar 22 provides for conventional manual tripping capabilities via a hole in the unshown cover of the housing.

While the invention has been particularly shown and described with reference to a preferred embodiment, as mentioned above, it will be understood by those skilled in the art that various other modifications and changes may be made to the present invention without departing from the spirit and scope thereof.

We claim:

1. An electromagnetic trip assembly for actuating a tripping function in a circuit breaker, said assembly comprising:

a housing;

an armature movably supported in said housing for movement from a first position toward a second position;

a compressible bias member supported within said housing for biasing the armature in said first position;

electromagnetic means, disposed near said armature, for providing an electromagnetic field in response to an overload level of current through a circuit in said circuit breaker which compresses said compressible bias member and moves said armature from said first position toward said second position; and tripping means including a tripping member which is supported adjacent to said armature in said housing such that said armature, in response to being drawn from said first position, applies a force against said tripping member to actuate the tripping function in the circuit breaker.

2. An electromagnetic trip assembly, as set forth in claim 1, including a conductor of said circuit disposed between the armature and the electromagnetic means.

3. An electromagnetic trip assembly, as set forth in claim 1, wherein the compressible bias member includes a spring having a spring constant which corresponds to the overload current.

4. An electromagnetic trip assembly, as set forth in claim 3, wherein said spring is a compression spring, and wherein said armature includes a seat for supporting the spring such that compression of the spring on the seat biases the armature in the first position.

5. An electromagnetic trip assembly, as set forth in claim 1, wherein the housing supports a portion of the trip member between the armature and the electromagnetic means such that the armature strikes said portion of the trip member as the armature is being drawn toward the electromagnetic means when said armature is moved from said first position toward said second position by the electromagnetic field from said electromagnetic means.

6. An electromagnetic trip assembly, as set forth in claim 1, wherein the electromagnetic means includes a concave portion facing the armature for reducing contact surface between the armature and the electromagnetic means when the armature approaches the second position.

7. An electromagnetic trip assembly, as set forth in claim 6, wherein the concave portion is formed in part by at least one pole face angularly extending from a recessed section of the electromagnetic means.

8. A substantially fastenerless electromagnetic trip assembly suitable for effecting the release of a set of circuit breaker contacts, comprising:

an armature which is responsive to an electromagnetic field;

a trip member, responsive to movement of the armature, for triggering the release of the set of circuit breaker contacts;

electromagnetic means, disposed near the armature, for providing said electromagnetic field in response to an overload level of current flowing in the circuit breaker;

a compressible bias member, having a bias parameter corresponding to the overload level of current, for biasing the armature in a normal position; and a housing including means for rigidly supporting the electromagnetic means, means for movably supporting the armature adjacent to the electromagnetic means, and means for supporting the compressible bias member such that the armature is biased away from the electromagnetic means in the normal position, and including means for movably supporting the trip member such that when the overload level of current occurs, the compressible bias member is compressed and the armature is drawn toward the electromagnetic means and strikes the trip member, causing the trip member to actuate the release of the set of circuit breaker contacts.

9. An electromagnetic trip assembly, as set forth in claim 8, including a conductor, located between the armature and the electromagnetic means, for carrying the overload level of current.

10. An electromagnetic trip assembly, as set forth in claim 8, wherein the compressible bias member includes a spring which is compressed to provide the bias on the armature.

11. An electromagnetic trip assembly, as set forth in claim 10, including a seat coupled to the armature for supporting the spring such that the compression of the spring biases the armature in the normal position.

12. An electromagnetic trip assembly, as set forth in claim 10, wherein said means for supporting the compressible bias member defines a tubularly shaped compartment for retaining the spring.

13. An electromagnetic trip assembly, as set forth in claim 12, including a conductor, located between the armature and the electromagnetic means, for carrying the overload level of current, and wherein the spring is compressed against the conductor within the compartment which retains the spring.

14. An electromagnetic trip assembly, as set forth in claim 12, wherein said armature includes a seat for supporting the spring within the compartment.

15. An electromagnetic trip assembly, as set forth in claim 8, wherein said means for movably supporting the armature includes means for rotatably retaining the armature about a shoulder coupled therewith.

16. An electromagnetic trip assembly, as set forth in claim 8, wherein the trip member is supported by said housing means in line with the movement of the armature such that the armature strikes the trip member as the armature is being drawn toward the electromagnetic means.

17. An electromagnetic trip assembly, as set forth in claim 8, wherein the electromagnetic means includes a pair of pole faces which contribute to form a concave portion of the electromagnetic means which faces the armature for reducing contact surface between the armature and the electromagnetic means when the armature is fully drawn toward the electromagnetic means.

18. An electromagnetic trip assembly having a yoke for electromagnetically drawing an armature to initiate a contactor tripping function in response to an overload level of current, comprising:

a trip member, responsive to the movement of the armature to effect the actuation;

a seat coupled to the armature;

a compressible spring, partly supported by the seat, having a first state for biasing the armature away from the yoke and having a second state in which the spring is compressed with movement of the armature; and housing means including first means for rigidly supporting the yoke, second means for supporting the spring and for movably supporting the armature adjacent to the yoke, and third means for supporting the trip member adjacent to the armature such that in response to the electromagnetic draw, the spring is compressed by the seat and the armature strikes the trip member.

19. An electromagnetic trip assembly, as set forth in claim 18, including a conductor, supported by the housing means between the yoke and the armature, for carrying the overload current and for providing compression of the spring.

20. An electromagnetic trip assembly, as set forth in claim 19, wherein the second means further includes a tubularly shaped compartment for housing the seat and the spring such that the spring is compressed between the conductor and the seat and is further compressed when the armature is drawn toward the yoke.

21. An electromagnetic trip assembly, as set forth in claim 18, wherein the trip member is coupled to the armature such that the armature strikes the trip member as the armature is being drawn toward the yoke.

22. An electromagnetic trip assembly, as set forth in claim 18, wherein the yoke includes pole faces which contribute to the formation of a concave section facing the armature to reduce contact surface between the armature and the yoke when the armature is fully drawn toward the yoke.

23. An electromagnetic trip assembly suitable for use in a circuit breaker, comprising:

a housing;

a trip member;

an armature movably supported within said housing for striking said trip member;

a compressible bias member, having a bias parameter corresponding to an overload current level flowing in the circuit breaker, supported within said housing for biasing the armature in a normal position;

electromagnetic means, disposed near the armature, for providing an electromagnetic field in response to the overload level of current in the circuit breaker in order to compress the bias member and to move the armature out of its normal position toward the electromagnetic means;

said trip member, supported by said housing adjacent to said armature, for receiving a strike from said armature to actuate a tripping function in the circuit breaker as the armature moves toward the electromagnetic means.

24. An electromagnetic trip assembly, as set forth in claim 23, wherein the housing includes wall supports for rotatably supporting the trip member.

25. An electromagnetic trip assembly, as set forth in claim 24, wherein the housing further includes an armature compartment for rotatably retaining the armature.

26. An electromagnetic trip assembly, as set forth in claim 23, wherein the housing includes an armature compartment for rotatably retaining the armature.

27. An electromagnetic trip assembly, as set forth in claim 26, wherein the housing further includes a compartment for retaining the bias member against the armature.

28. An electromagnetic trip assembly, as set forth in claim 23, wherein the housing includes a compartment for rigidly retaining the electromagnetic means.

29. An electromagnetic trip assembly, as set forth in claim 23, wherein the housing includes a compartment for retaining the bias member against the armature.

30. An electromagnetic trip assembly having an armature with at least two edges adjacent one of its surfaces, a yoke which electromagnetically draws the armature for actuating a contactor tripping function in response to a predetermined level of current, the improvement comprising:

a concave shaped yoke formed in part by a pair of pole faces which each include an end having an interface surface toward which the armature edges are drawn such that the edges are used to maintain adequate separation between the armature and the yoke to prevent undesired elements from interfering with the electromagnetic drawing operation.

31. An electromagnetic trip assembly, as set forth in claim 30, wherein the concave shape is further formed by a recessed planar section between the pole faces.

32. An electromagnetic trip assembly, as set forth in claim 31, wherein the pole faces are angularly and linearly directed from said recessed section.

33. A circuit breaker, comprising:

a substantially fastenerless electromagnetic trip assembly for effecting the release of a set of circuit breaker contacts, comprising:

an armature movable in response to an electromagnetic field;

a trip member, responsive to the movement of the armature and coupled to the circuit breaker contact, for actuating the release of the set of circuit breaker contacts;

a yoke disposed near the armature for drawing the armature toward the yoke in response to an overload level of current flowing in the circuit breaker, said yoke having a concave shape for reducing surface contact between the yoke and the armature; and a first compressible bias member, having a bias parameter corresponding to the overload current level, for biasing the armature in a normal position; and a second bias member, coupled to the trip member, for biasing the trip member toward the armature; and a circuit breaker housing for retractably receiving the yoke, for retractably and rotatably receiving the first bias member such that the armature is biased away from the yoke in the normal position, and including support means for rotatably supporting the trip member such that when the overload current level occurs, the first bias member is compressed and the armature strikes the trip member as the armature moves toward the yoke, thereby actuating the release of the set of circuit breaker contacts.

* * * * *